US006955059B2

(12) United States Patent
Lifson et al.

(10) Patent No.: US 6,955,059 B2
(45) Date of Patent: Oct. 18, 2005

(54) VAPOR COMPRESSION SYSTEM

(75) Inventors: Alexander Lifson, Manlius, NY (US); Michael F. Taras, Fayetteville, NY (US); Howard H. Fraser, Jr., Woodstock, NY (US)

(73) Assignee: Carrier Corporation, Syracuse, NY (US)

( * ) Notice: Subject to any disclaimer, the term of this patent is extended or adjusted under 35 U.S.C. 154(b) by 248 days.

(21) Appl. No.: 10/389,487

(22) Filed: Mar. 14, 2003

(65) Prior Publication Data

US 2004/0177631 A1 Sep. 16, 2004

(51) Int. Cl.[7] ..... F25B 41/00; F25B 49/00
(52) U.S. Cl. ..... 62/197; 62/513
(58) Field of Search ..... 62/197, 196.1, 62/196.2, 513, 113

(56) References Cited

U.S. PATENT DOCUMENTS

| | | | | |
|---|---|---|---|---|
| 5,996,364 A * | 12/1999 | Lifson et al. | ..... | 62/196.1 |
| 6,047,556 A * | 4/2000 | Lifson | ..... | 62/196.2 |
| 6,058,729 A * | 5/2000 | Lifson et al. | ..... | 62/217 |
| 6,122,924 A * | 9/2000 | Lifson et al. | ..... | 62/192 |
| 6,138,467 A * | 10/2000 | Lifson et al. | ..... | 62/217 |
| 6,385,981 B1 * | 5/2002 | Vaisman | ..... | 62/196.3 |
| 6,571,576 B1 * | 6/2003 | Lifson et al. | ..... | 62/513 |

* cited by examiner

*Primary Examiner*—Marc Norman
(74) *Attorney, Agent, or Firm*—Bachman & LaPointe, PC

(57) ABSTRACT

A vapor compression system includes a main vapor compression circuit including a compressor, a condenser, an expansion device and an evaporator serially connected by main refrigerant lines, the compressor having a main discharge port, a suction port and an economizer/bypass port, an economizer circuit connected between the condenser and the economizer/bypass port of the compressor and including an auxiliary expansion device and a heat exchanger serially connected by economizer refrigerant lines, the economizer refrigerant lines and the main refrigerant lines being exposed to each other for heat exchange in the heat exchanger; and a bypass circuit including a bypass line extending from the economizer/bypass port to the suction port, and a bypass valve positioned along the bypass line, the bypass valve being positionable between a closed position wherein the economizer circuit is active and the bypass circuit is inactive, and an open position wherein the economizer circuit is active and the bypass circuit is active. The system and method advantageously allow for the economizer circuit and bypass circuit to be operational at the same time. By using an electronically controlled auxiliary expansion device, four modes of operation are permissible. As a result, life cycle and system costs can be reduced and compressor reliability and system performance can be enhanced. Additionally the control scheme and method extend the system operating envelope, hence preventing nuisance shutdowns, and further improving compressor reliability.

10 Claims, 1 Drawing Sheet

VAPOR COMPRESSION SYSTEM

BACKGROUND OF THE INVENTION

The invention relates to economized vapor compression systems and, more particularly, to an economized vapor compression system with improved performance.

Over their life cycle HVAC & R systems frequently operate unloaded and, thus, system performance enhancement in unloaded mode of operation is critical. Economized systems may employ economizer-to-suction bypass as means of unloading the compressor, which is a very efficient method of system capacity reduction and external load matching.

Additionally, such vapor compression systems operate at a wide range of environmental conditions and it is essential to increase the system operating envelope, hence preventing nuisance shutdowns.

System cost is also a critical concern and a key criteria for product acceptance by the market.

Based upon the foregoing, the need exists for enhanced performance of such systems in an unloaded mode of operation, as well as for systems having reduced cost.

It is therefore the primary object of the present invention to provide such a system.

Other objects and advantages of the present invention will appear hereinbelow.

SUMMARY OF THE INVENTION

In accordance with the present invention, the foregoing objects and advantages have been readily attained.

According to the invention, a vapor compression system is provided which comprises a main vapor compression circuit comprising a compressor, a condenser, an expansion device and an evaporator serially connected by main refrigerant lines, said compressor having a main discharge port, a suction port and an economizer/bypass port, an economizer circuit connected between said condenser and said economizer/bypass port of said compressor and comprising an auxiliary expansion device and a heat exchanger serially connected by economizer refrigerant lines, said economizer refrigerant lines and said main refrigerant lines being exposed to each other for heat exchange in said heat exchanger; and a bypass circuit comprising a bypass line extending from said economizer/bypass port to said suction port, and a bypass valve positioned along said bypass line, said bypass valve being positionable between a closed position wherein said economizer circuit is active and said bypass circuit is inactive, and an open position wherein said economizer circuit is active and said bypass circuit is active.

Furthermore, a method is provided according to the present invention for operating a vapor compression system comprising a main vapor compression circuit including a compressor, a condenser, an expansion device and an evaporator serially connected by main refrigerant lines, said compressor having a main discharge port, a suction port and an economizer/bypass port, an economizer circuit connected between said condenser and said economizer/bypass port of said compressor and including an auxiliary expansion device and a heat exchanger serially connected by economizer refrigerant lines, said economizer refrigerant lines and said main refrigerant lines being exposed to each other for heat exchange in said heat exchanger, and a bypass circuit including a bypass line extending from said economizer/bypass port to said suction port, and a bypass valve positioned along said bypass line, said bypass valve being positionable between a closed position wherein said economizer circuit is active and said bypass circuit is inactive, and an open position wherein said economizer circuit is active and said bypass circuit is active, comprising selectively operating said system in a first mode of operation wherein said bypass valve is closed, said bypass circuit is inactive and said economizer circuit is active, and a second mode of operation wherein said bypass valve is open, said bypass circuit is active and said economizer circuit is active.

BRIEF DESCRIPTION OF THE DRAWINGS

A detailed description of preferred embodiments of the present invention follows, with reference to the attached drawing, wherein.

DETAILED DESCRIPTION

Figure 1:
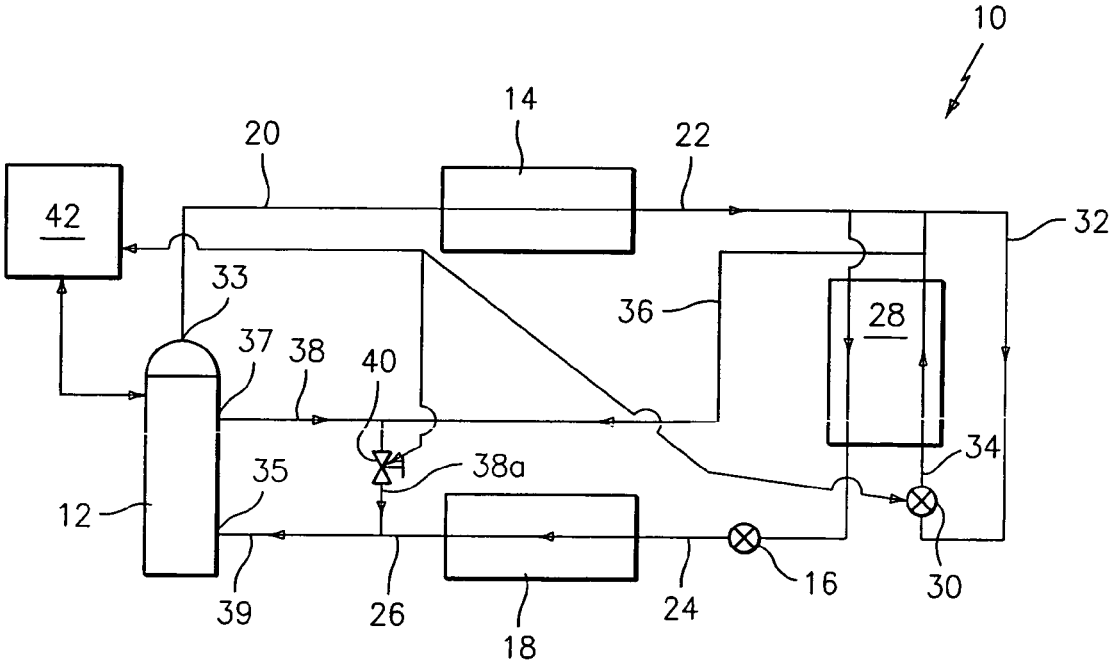
FIG. 1 schematically illustrates a system in accordance with the present invention.

The invention relates to a vapor compression system and, more particularly, to a vapor compression system adapted to provide improved performance and further to reduce cost through simplification of hardware requirements.

In accordance with the present invention, and advantageously, a bypass circuit can be utilized to operate the compressor in an unloaded condition while maintaining an economizer circuit active at the same time. The system and method of the present invention advantageously provide multiple modes of operation which allow the compressor to be operated to more closely match an external load. This advantageously allows for reduction in cycling of the system, hence improving system reliability and reducing temperature variations in the conditioned space. Additionally, novel control scheme permits widening of the system operational envelope and ehances compressor performance as well.

FIG. 1 shows a vapor compression system 10 including a compressor 12, a condenser 14, an expansion device 16 and an evaporator 18, and these components are serially connected by main refrigerant lines as shown in the drawing. In operation, as is well known to a person of ordinary skill in the art, compressor 12 drives refrigerant through line 20 to condenser 14, from condenser 14 through line 22 to main expansion device 16, from main expansion device 16 through line 24 to evaporator 18, and from evaporator 18 through line 26 and back to compressor 12.

Also as shown in FIG. 1, system 10 in accordance with the present invention includes a performance improving "economizer" circuit which includes an auxiliary expansion device 30 and an economizer heat exchanger 28 which are serially connected by additional refrigerant lines between condenser 14 and compressor 12.

Flow in the economizer circuit extends or branches off from the main refrigerant line, preferably through economizer refrigerant flow line 32 which branches from main refrigerant line 22 and flows to auxiliary expansion device 30, from auxiliary expansion device 30 through economizer refrigerant line 34 to economizer heat exchanger 28, from economizer heat exchanger 28 through economizer refrigerant lines 36 and back to compressor 12 as will be further discussed below.

As shown in the drawing, main refrigerant line 22 also passes through economizer heat exchanger 28 in heat exchange relationship with the economizer refrigerant line flowing therethrough. Flow through the economizer circuit is expanded in the auxiliary expansion device 30 and used to further cool refrigerant in the main refrigerant line 22 as desired.

Still further as shown in the drawing, compressor 12 also has an economizer-to-suction bypass circuit defined by line 38, line 38*a* and line 39 which allows compressor 12 to be operated in the unloaded condition as desired, and which combines the flow from bypass line 38 with refrigerant from the economizer refrigerant line 36 for recycle back to the compressor suction port in the unloaded mode of operation.

Still referring to the drawing, a bypass shutoff valve 40 is provided for selectively controlling operation of the bypass circuit as desired.

Compressor 12 has several ports through which flow occurs during operation of same, including a main discharge port 33, a suction port 35 and an economizer/bypass port 37. These ports can have various different configurations, as is known to a person of ordinary skill in the art, and it should further be appreciated that economizer/bypass port 37 provides different functions as described below, and could be provided as one port or as separate ports.

Flow in the economizer circuit flows back to compressor 12 in different ways depending upon whether compressor 12 is operating in an unloaded mode or in a fully loaded mode. In the unloaded mode, when bypass vale 40 is open, combined flow from economizer refrigerant circuit (line 36) and from the bypass circuit (line 38) flows through bypass line 38*a* and rejoins main flow in refrigerant line 26 as shown in the drawings. This flow then enters compressor 12 through suction port 35.

In the fully loaded mode of operation, when bypass valve 40 is closed, flow from economizer refrigerant line 36 returns to compressor 12 through line 38 and the economizer bypass port 37.

It should be noted that valves referred to herein as closed include valves which are substantially closed so as to prevent meaningful flow therethrough, such that the circuit containing the valve is substantially inactive and valves referred to as open include those which are substantially open so as to allow meaningful flow therethrough, such that the circuit containing the valve is substantially active.

Traditionally, when operation in an unloaded condition is desired, the economizer circuit is shut down. In accordance with the present invention, however, with bypass valve 40 open, the economizer circuit maintains its normal function of providing additional sub-cooling of the main refrigerant stream. This auxiliary or economizer vapor stream, after leaving the economizer heat exchanger and absorbing heat from the main refrigerant flow, is combined with the flow from the bypass circuit and returned back to compressor suction port 35.

Thus, in accordance with the present invention, system performance is enhanced through the utilization of the economizer circuit, which performs its economizing function in the unloaded mode of operation over a larger temperature difference, and therefore has a higher heat transfer potential. This at least partially compensates for a portion of the refrigerant flow diverted through the economizer circuit. Consequently, evaporator performance can be augmented due to reduction in refrigerant pressure drop.

Further, configuration of a system in accordance with the present invention allows the economizer circuit to be connected substantially as shown, without requiring a shut-off valve or other flow control mechanism which, of course, can add to the cost of the system.

In further accordance with the present invention, the mixing of the economizer refrigerant stream and the bypass flow may allow suction superheat reduction due to appropriate control of the refrigerant state at the economizer heat exchanger exit, thus decreasing discharge temperature and widening the system operating envelope. Furthermore, compressor performance and reliability are enhanced accordingly.

Still referring to FIG. 1, a control unit 42 can advantageously be provided and operatively associated with bypass valve 40 and auxiliary expansion device 30. In such a configuration, control unit 42 can be adapted to control operation of auxiliary expansion device 30 and bypass valve 40, and this is particularly advantageous in situations where auxiliary expansion device 30 is an electronic expansion device.

In such a configuration, it may further be desirable to communicate control unit 42 with compressor 12 such that control unit 42 can determine or obtain a compressor operating parameter such as compressor discharge temperature and control unit 42 is further advantageously programmed and adapted to control bypass valve 40 and/or additional expansion device 30 based upon input received from compressor 12 related to such compressor discharge temperature. Furthermore, this control configuration advantageously allows system 10 in accordance with the present invention to be operated in a conventional, or fully loaded and non-economized mode, in a fully loaded and economized mode, in an unloaded and economized mode, and in an unloaded, non-economized mode. Such switching between these modes of operation and refrigerant state adjustment at the exit of economizer heat exchanger 28 in line 36 can be controlled by control unit 42 whereby reduction in the system capacity is instituted when required by external load as well as compressor operation boundaries in order to prevent the unit from shutdown, reduce life cycle cost and improve system reliability.

If auxiliary expansion device 30 is not controlled electronically, then the number of operation modes is reduced to two highly efficient modes, which is still beneficial from performance and cost perspectives, or otherwise a controllable shutoff valve can be added, for example, to line 32.

In the conventional mode of operation, bypass valve 40 and auxiliary expansion device 30 would be selectively controlled so as to block flows through the bypass circuit and the economizer circuit.

In the fully loaded economized mode, bypass valve 40 is closed and auxiliary expansion device 30 is opened to allow flow through the economizer circuit.

In the unloaded and economized mode of operation, bypass valve 40 and auxiliary expansion device 30 are operated in an open state so as to allow flow through both the bypass circuit and economizer circuit.

In the unloaded, non-economized mode, bypass valve 40 can be opened and auxiliary expansion device 30 closed so as to allow flow through the bypass circuit and not the economizer circuit as desired.

It should of course be appreciated that, for the purpose of preventing system shutdowns due to operation outside of permitted boundaries, conditions at the economizer exit can also be controlled in similar fashion and by adjusting opening of auxiliary expansion device 30. For example, auxiliary expansion device 30 can be selectively operated to control temperature and/or phase of flow leaving heat exchanger 28, for example to provide two-phase flow leaving heat exchanger 28 and flowing to suction port 35 of compressor 12. Control of this portion of flow to suction port 35 allows control over the discharge temperature of compressor 12, and thereby broadens the operating envelope of compressor 12 as desired.

It should be appreciated that the foregoing system advantageously provides for enhanced performance of a vapor compression system, a reduction in cost of the system, reduction in life-cycle operation cost, improved system reliability, and expansion of operating envelope all as desired.

What is claimed is:

1. A vapor compression system, comprising:

a main vapor compression circuit comprising a compressor, a condenser, an expansion device and an evaporator serially connected by main refrigerant lines, said compressor having a main discharge port, a suction port and an economizer/bypass port, an economizer circuit connected between said condenser and said economizer/bypass port of said compressor and comprising an auxiliary expansion device and a heat exchanger serially connected by economizer refrigerant lines, said economizer refrigerant lines and said main refrigerant lines being exposed to each other for heat exchange in said heat exchanger; and a bypass circuit comprising a bypass line extending from said economizer/bypass port to said suction port, and a bypass valve positioned along said bypass line, said bypass valve being positionable between a closed position wherein said economizer circuit is active and said bypass circuit as inactive, and an open position wherein said economizer circuit is active and said bypass circuit is active; and a control unit operatively associated with at least one of said bypass valve and said auxiliary expansion device for controlling same, said control unit being adapted to selectively operate said system in a first mode of operation wherein said bypass valve is closed, said bypass circuit is inactive and said economizer circuit is active, and a second mode of operation wherein said bypass valve is open, said bypass circuit is active and said economizer circuit is active.

2. The system of claim 1, wherein, when said bypass valve is open, flow through said bypass circuit, said economizer circuit and said main vapor compression circuit combine and flow to said suction port of said compressor, and when said bypass valve is closed, flow from said economizer circuit enters said economizer/bypass port and flow from said main vapor compression circuit enters said suction port.

3. The system of claim 1, wherein said control unit is communicated with said compressor so as to determine a parameter related to compressor discharge temperature, and wherein said control unit is adapted to open and close said bypass valve based upon said parameter, whereby said system can be selectively operated with said bypass circuit inactive and said economizer circuit active, and with said bypass circuit active and said economizer circuit active.

4. The system of claim 1, wherein said auxiliary expansion device is an electronic expansion device which can be selectively controlled to allow and block flow through said economizer circuit.

5. The system of claim 4, wherein said control unit is communicated with said compressor so as to determine a parameter related to compressor discharge temperature and wherein said control unit is adapted to open and close said bypass valve and said auxiliary expansion device based upon said parameter, whereby said system can be selectively operated with said bypass circuit and said economizer circuit inactive, with said bypass circuit inactive and said economizer circuit active, with said bypass circuit and said economizer circuit active, and with said economizer circuit inactive and said bypass circuit active.

6. A method for operating a vapor compression system comprising a main vapor compression circuit including a compressor, a condenser, an expansion device and an evaporator serially connected by main refrigerant lines, said compressor having a main discharge port, a suction port and an economizer/bypass port, an economizer circuit connected between said condenser and said economizer/bypass port of said compressor and including an auxiliary expansion device and a heat exchanger serially connected by economizer refrigerant lines, said economizer refrigerant lines and said main refrigerant lines being exposed to each other for heat exchange in said heat exchanger, and a bypass circuit including a bypass line extending from said economizer/bypass port to said suction port, and a bypass valve positioned along said bypass line, said bypass valve being positionable between a closed position wherein said economizer circuit is active and said bypass circuit is inactive, and, an open position wherein said economizer circuit is active and said bypass circuit is active, comprising:

selectively operating said system in a first mode of operation wherein said bypass valve is closed, said bypass circuit is inactive and said economizer circuit is active, and a second mode of operation wherein said bypass valve is open, said bypass circuit is active and said economizer circuit is active.

7. The method of claim 6, wherein said auxiliary expansion device is an electronic expansion device which can be selectively controlled to allow and block flow through said economizer circuit, and wherein said selectively controlling step comprises selectively controlling said bypass valve and said electronic expansion device so as to operate said system in a first mode of operation wherein said bypass circuit is active and said economizer circuit is active, a second mode of operation wherein said bypass circuit is inactive and said economizer circuit is active, a third mode of operation wherein said bypass circuit is active and said economizer circuit is inactive, and a fourth mode of operation wherein said bypass circuit is inactive and said economizer is inactive.

8. The method of claim 6, further comprising selectively operating said auxiliary expansion device so as to control at least one of temperature and phase of flow leaving said heat exchanger whereby temperature of flow to said suction port can be controlled.

9. A vapor compression system, comprising:

a main vapor compression circuit comprising a compressor, a condenser, an expansion device and an evaporator serially connected by main refrigerant lines, said compressor having a main discharge port, a suction port and an economizer/bypass port, an economizer circuit connected between said condenser and said economizer/bypass port of said compressor and comprising an auxiliary expansion device and a heat exchanger serially connected by economizer refrigerant lines, said economizer refrigerant lines and said main refrigerant lines being exposed to each other for heat exchange in said heat exchanger; and a bypass circuit comprising a bypass line extending from said economizer/bypass port to said suction port, and a bypass valve positioned along said bypass line, said bypass valve being positionable between a closed position wherein said economizer circuit is active and said bypass circuit is inactive, and an open position wherein said economizer circuit is active and said bypass circuit is active, and further comprising a control unit operatively associated with at least one of said bypass valve and said auxiliary expansion device for controlling same, wherein said control unit is communicated with said compressor so as to determine a parameter related to compressor discharge temperature, and wherein said control unit is adapted to open and close said bypass valve based upon said parameter, whereby said system can be selectively operated with said bypass circuit inactive and said economizer circuit active, and with said bypass circuit active and said economizer circuit active.

10. A vapor compression system, comprising:

a main vapor compression circuit comprising a compressor, a condenser, an expansion device and an evaporator serially connected by main refrigerant lines, said compressor having a main discharge port, a suction port and an economizer/bypass port, an economizer circuit connected between said condenser and said economizer/bypass port of said compressor and comprising an auxiliary expansion device and a heat exchanger serially connected by economizer refrigerant lines, said economizer refrigerant lines and said main refrigerant lines being exposed to,each other for heat exchange in said heat exchanger; and a bypass circuit comprising a bypass line extending from said economizer/bypass port to said suction port, and a bypass valve positioned along said bypass line, said bypass valve being positionable between a closed position wherein said economizer circuit is active and said bypass circuit is inactive, and an open position wherein said economizer circuit is active and said bypass circuit is active, and further comprising a control unit operatively associated with at least one of said bypass valve and said auxiliary expansion device for controlling same, wherein said auxiliary expansion device is an electronic expansion device which can be selectively controlled to allow and block flow through said economizer circuit, and wherein said control unit is communicated with said compressor so as to determine a parameter related to compressor discharge temperature and wherein said control unit is adapted to open and close said bypass valve and said auxiliary expansion device based upon said parameter, whereby said system can be selectively operated with said bypass circuit and said economizer circuit inactive, with said bypass circuit inactive and said economizer circuit active, with said bypass circuit and said economizer circuit active, and with said economizer circuit inactive and said bypass circuit active.

* * * * *